US007036497B2

(12) United States Patent
Horn

(10) Patent No.: US 7,036,497 B2
(45) Date of Patent: May 2, 2006

(54) ARCHERY BOW STAND

(76) Inventor: Edward Horn, 6001 Charter Oak La. SE., Cedar Rapids, IA (US) 52403

( * ) Notice: Subject to any disclaimer, the term of this patent is extended or adjusted under 35 U.S.C. 154(b) by 0 days.

(21) Appl. No.: 10/753,647

(22) Filed: Jan. 8, 2004

(65) Prior Publication Data

US 2005/0150484 A1 Jul. 14, 2005

(51) Int. Cl.
*F41B 5/00* (2006.01)

(52) U.S. Cl. ..... 124/86

(58) Field of Classification Search ..... 124/23.1, 124/86, 88, 89
See application file for complete search history.

(56) References Cited

U.S. PATENT DOCUMENTS 3,256,872 A * 6/1966 Koser ..... 124/23.1
4,993,398 A * 2/1991 Wallace ..... 124/23.1
5,106,044 A * 4/1992 Regard et al. ..... 248/169
5,205,272 A * 4/1993 Boyer ..... 124/89
5,535,731 A * 7/1996 Webster ..... 124/89
5,547,162 A * 8/1996 Sobolewski et al. ..... 248/688
5,630,407 A * 5/1997 Gasser ..... 124/89
6,205,992 B1 * 3/2001 Meeks et al. ..... 124/86

* cited by examiner

*Primary Examiner*—John A. Ricci
(74) *Attorney, Agent, or Firm*—Allan L. Harms

(57) ABSTRACT

A bow stand attachment for an archery bow has a base which mounts to the riser of the bow. The base has a pair of legs extending downward from it. The legs are slid onto stubs which extend away and downward from the outer rim of the base. The ends of the legs and the end of a stabilizer mounted to the bow can cooperate to provide a supporting tripod for the bow. When no stabilizer is attached to the bow, the bow stand and lower pulley act as a tripod to support the bow. Performance of the bow is not affected by presence of the attachment because of its low mass and symmetry on the riser of the bow.

12 Claims, 7 Drawing Sheets

ARCHERY BOW STAND

STATEMENT REGARDING FEDERALLY SPONSORED RESEARCH OR DEVELOPMENT

Not Applicable.

BACKGROUND OF THE INVENTION

In modern archery, compound bows are used which include a central handle section known as a riser, and limbs which extend from the upper and lower ends of the riser. The limbs are adjustable upon the ends of the risers by the tightening or loosening of fasteners mounting the limbs to the riser. The bowstring is strung between pulleys on the limbs. In hunting, target, archery, etc. the archer finds frequent occasions to set his or her bow down including while retrieving arrows from the target. Historically, archers have merely laid their bows on the floor or ground surface with the handle and limbs resting on the floor or ground which can scuff or mar the surfaces of the bow components and may result in dirt or sand coming in contact with the string pulley components. Laying the bow on the ground or floor increases the risk of misaligning the sight and of course, the bow could be accidently trampled on. Obviously it would be preferable not to lay a precision, fine tuned compound bow on the ground. If an upright wall or other structure is nearby, the archer may set the bow on the ground or floor surface and lean the upper end of the bow against the upright structure with the lower string pulley resting on the ground or floor, increasing the likelihood of damage and wear to the lower pulley, with the concomitant risk that the bow will not be stable and will fall over.

A few devices have been developed to hold an archery bow so that it need not be laid on the ground or rested on its lower members. In one device, a weighted base has an upstanding post mounted to it, with a hook arrangement positioned on the post on which the bow may be suspended so that it does not touch the ground. Exemplary of such a device is the ARCHERY STAND-BY bow stand marketed by Wildwood Innovations, Inc. of Ashland, Wis. This type of device adds a somewhat heavy piece of equipment to be carried to the shooting location.

Another bow holding device includes a clamp member which grasps the lower limb of the bow. This device cannot be left on the bow when shooting because its mass interferes with the action of the limb and therefore the accuracy of the shot. In addition, the clamping action tends to chafe the surface finish of the bow limb, thereby reducing the value of the bow. What is needed is a low mass attachment for a bow which can provide a support for the bow which prevents the bow from touching the ground or floor when rested and which can be left on the bow while shooting without affecting the physical characteristics of the bow.

BRIEF SUMMARY OF THE INVENTION

The present invention is a bow stand attachment for a compound bow. The bow stand attachment attaches to the riser or limb bolt rather than the limb, and is of low mass. In one embodiment, a conical base member is substituted for the conical washer used in coupling the lower limb of the bow to the bow handle. The base member includes two short protruding elements which depend forward from the base member at approximately thirty degrees and are separated by about forty degrees. Easily removable extending legs are slid onto each protruding element to serve as two legs of a tripod. If the bow has a stabilizer, the end of the stabilizer will serve as the third leg. If the bow has no stabilizer, the bow will rest on the ends of the legs and on the lower pulley wheel. Though the legs of the bow stand invention are intended to be removed when shooting, the bow may be used without removing the bow stand legs because their mass is small and evenly distributed on the bow and because the bow stand attachment does not attach to the lower limb of the bow. Consequently the legs do not substantially affect the physics of the bow when it is used. In practice, the user will remove the legs from the base member when shooting because the legs may be quickly and easily reattached to the base member.

It is therefore an object of the invention to provide a bow stand attachment which may remain on the bow without affecting the performance of the bow while it is being used. It is a further object of the invention to provide a bow stand with legs which can be quickly and easily removed and reattached as needed. It is also an object of the invention to provide a bow stand which has a base member which can remain on the bow so that the bow may be transported in its usual carrying case. It is also an object of the invention to provide a bow stand which mounts to the riser of the bow and does not affect the operation of the bow limbs. It is a further object of the invention to provide a bow stand which will not mar the external surface of the bow or its limbs.

These and other objects of the invention will become apparent from examination of the description and claims which follow.

BRIEF DESCRIPTION OF THE SEVERAL VIEWS OF THE DRAWING(S)

DETAILED DESCRIPTION OF THE INVENTION

Figure 1:
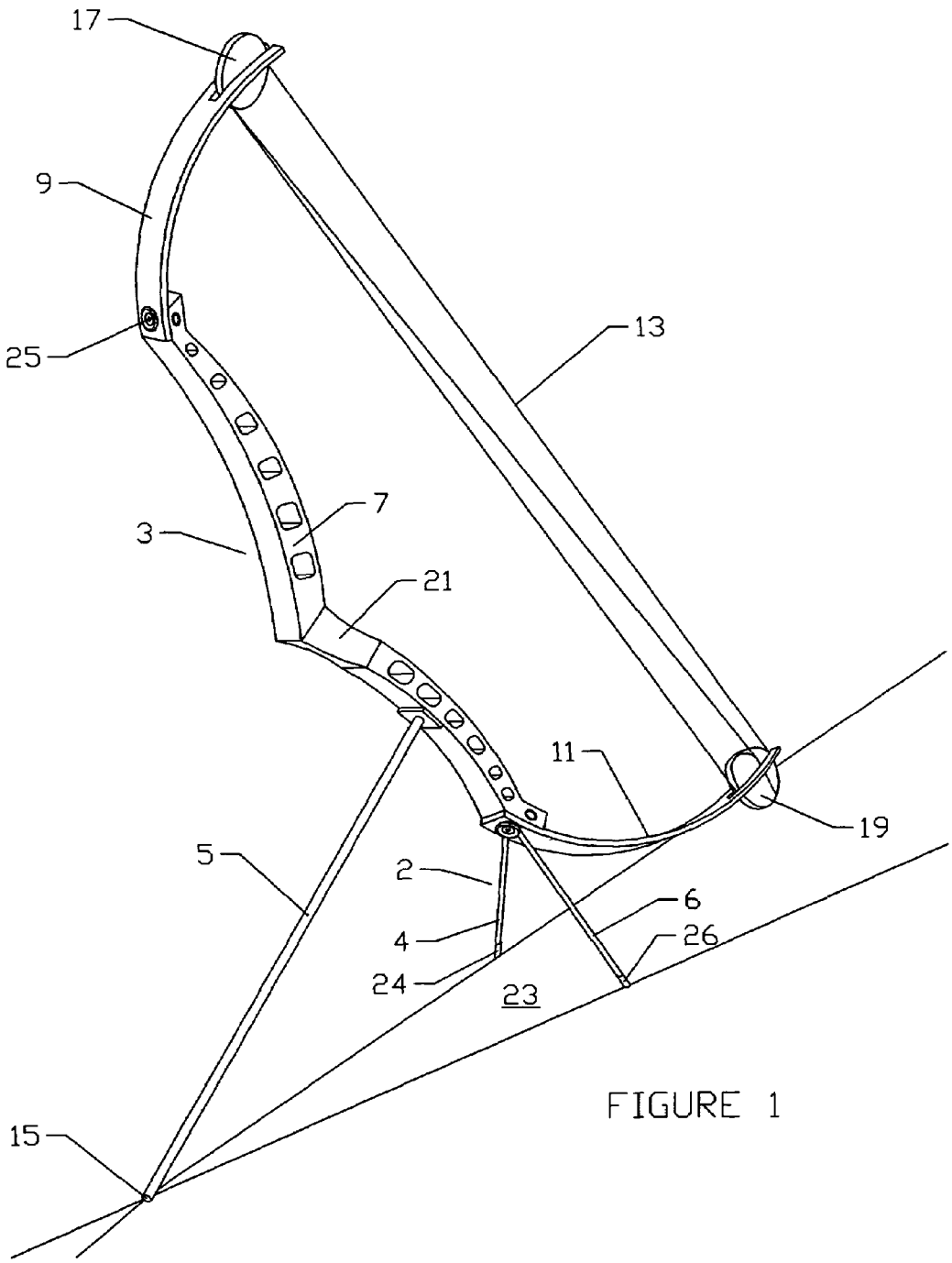
FIG. 1 is a perspective of a compound bow supported on a surface by the invention bow stand in cooperation with a stabilizer.

Throughout this description, like elements are identified with the same reference numerals.

FIG. 1 illustrates a compound bow 3 resting on surface 23 supported on the free end 15 of a stabilizer 5 and on the invention 2 which has been mounted to bow 3. Bow 3 comprises a handle or riser 7 with an upper limb 9 and a lower limb 11 mounted thereto at its opposing ends. A conical washer 25 provides an adjustable connection for upper limb 9 to riser 7. Bow 3 includes a bowstring 13 which is strung between upper pulley 17 and lower pulley 19. Stabilizer 5 is a linear rod which is mounted to bow 3 below grip 21 and is a well known accessory for a target bow. Invention 2 comprises legs 4, 6 having free ends 24, 26 respectively which with free end 15 of stabilizer 5 define a plane. Legs 4, 6 cooperate with stabilizer 5 to form a tripod to support bow on floor surface 23 such that lower limb 11 and lower pulley 19 do not rest on floor surface 23. Critical to the effectiveness of invention 2 is its attachment to the riser 7 and not to lower limb 11. If bow 3 had no stabilizer attachment, bow 3 would instead rest on legs 4, 6 and on lower pulley 19.

Figure 2:
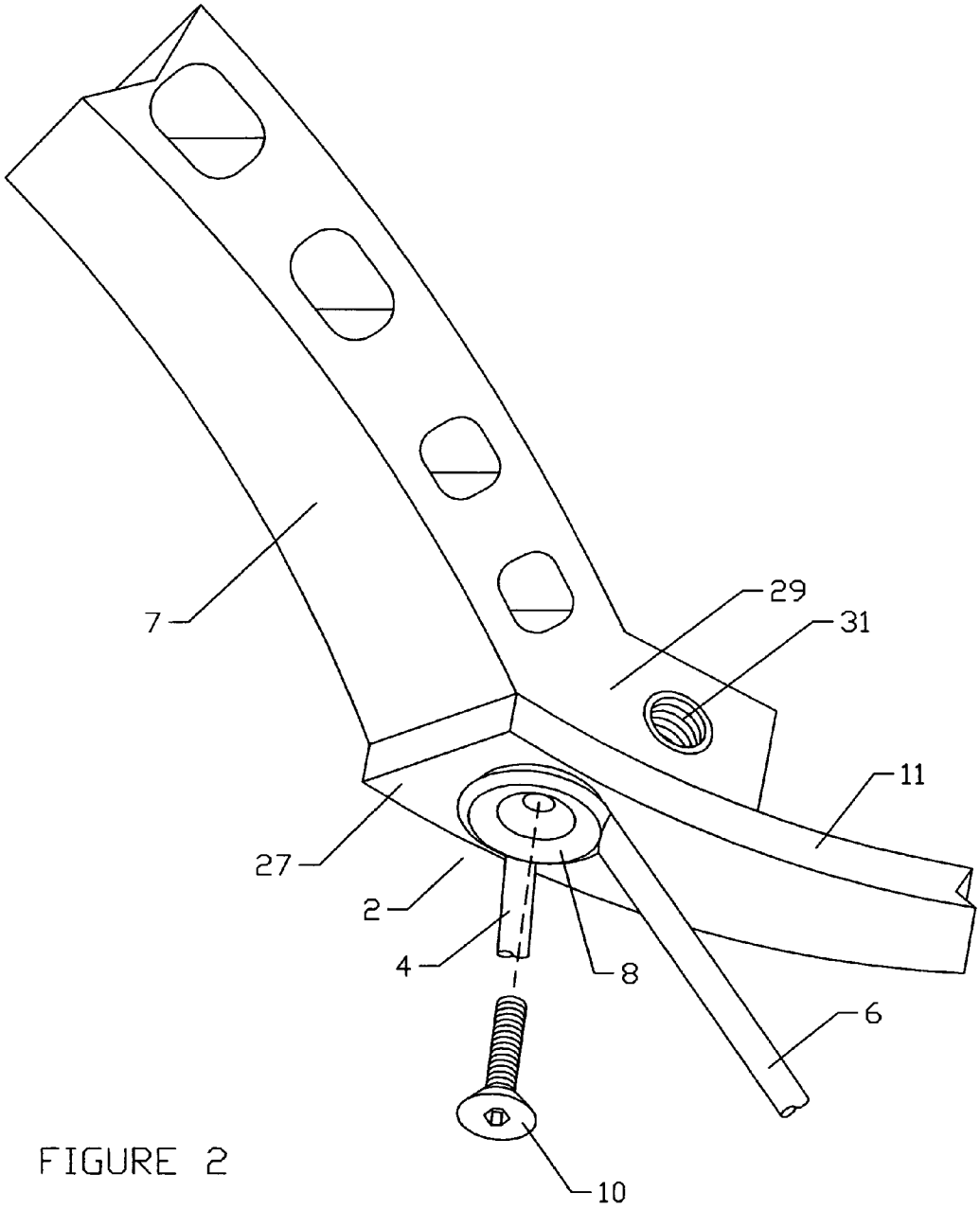
FIG. 2 is a close up view in perspective of the invention mounted to a compound bow, with parts of the invention and the bow cut away, and with a mounting fastener exploded from the invention and bow.

Referring now to FIG. 2, invention 2 is shown with parts of its legs 4, 6 cut away. In the preferred embodiment illustration in FIG. 2 invention 2 mounts to riser 7 by bolt 10 where lower limb 11 is fastened to riser 7. Invention 2 comprises a base 8 which replaces a typical conical washer such as conical washer 25 (FIG. 1) which retains upper limb 9 to riser 7. Bolt 10 passes through base 8 and through first end 27 of lower limb 11 and is secured into lower end 29 of riser 7. Bolt 10 may be selectively tightened to compress base 8 into a recess in lower limb 11 to adjust the angle of lower limb 11 relative to riser 7 under tension created by bowstring 13.

Figure 3:
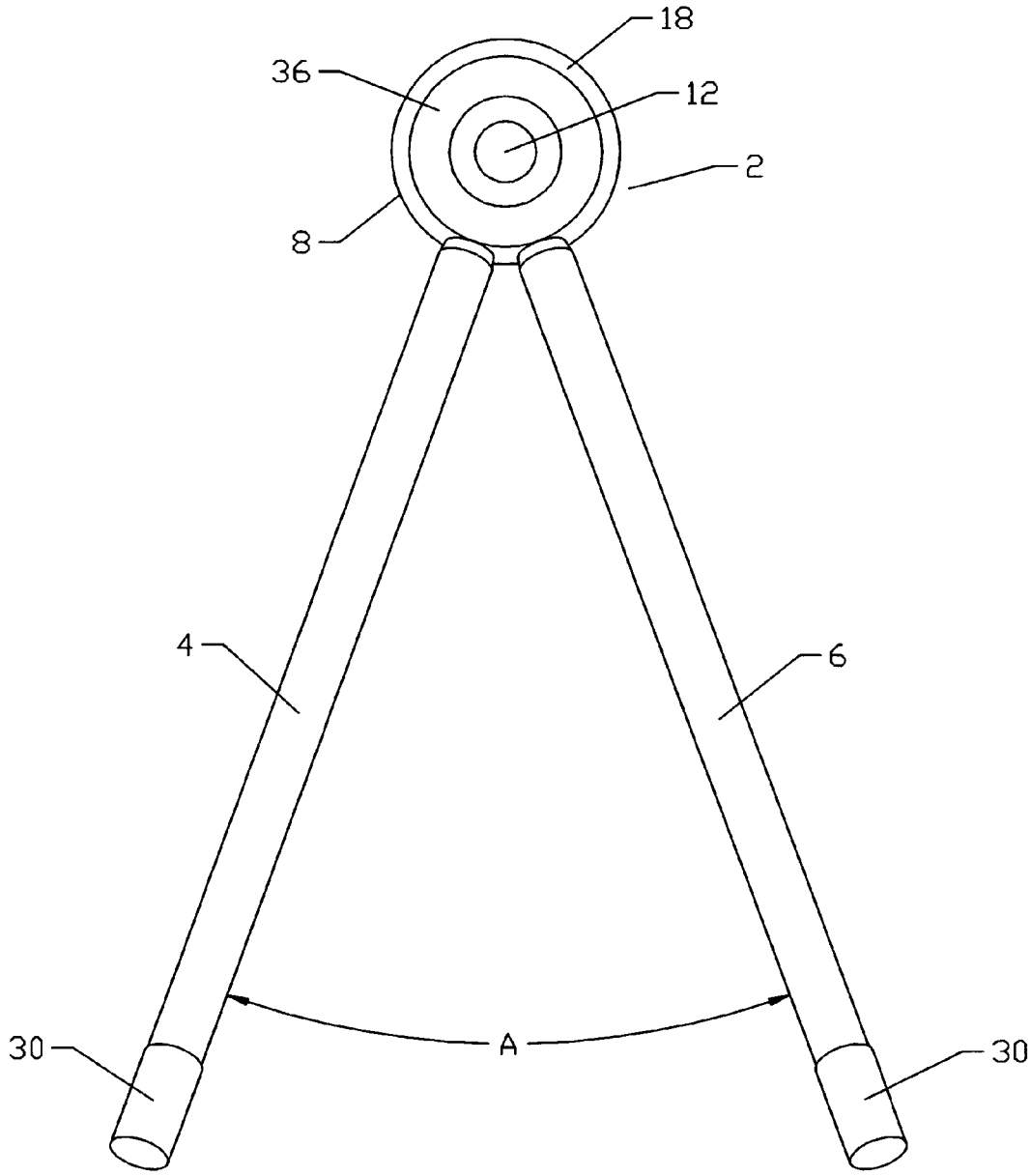
FIG. 3 is a front elevation of the bow stand of the present invention.
Figure 4:
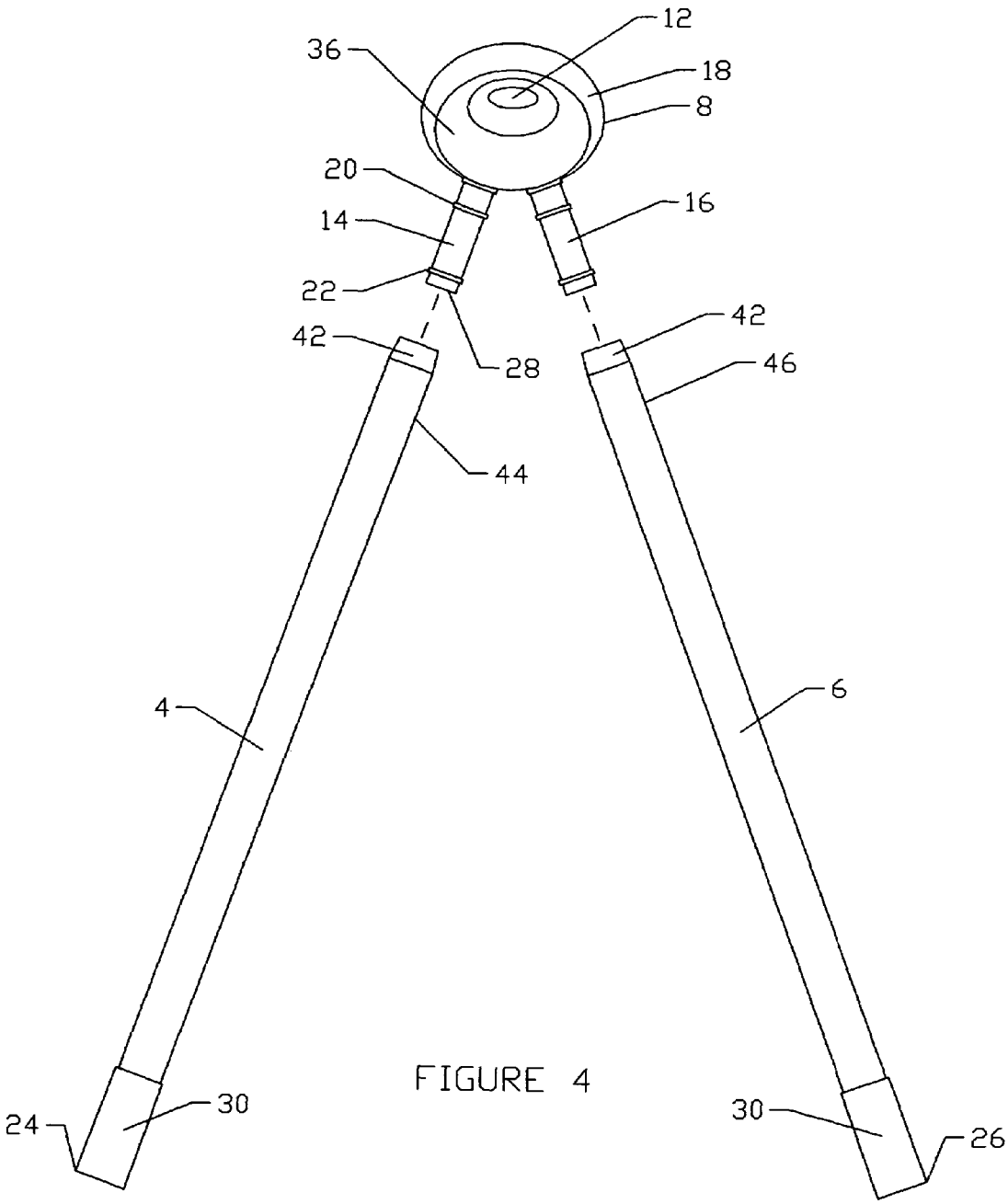
FIG. 4 is a front perspective of the bow stand of the present invention shown with one leg of the invention separated from the base member of the invention.
Figure 5:
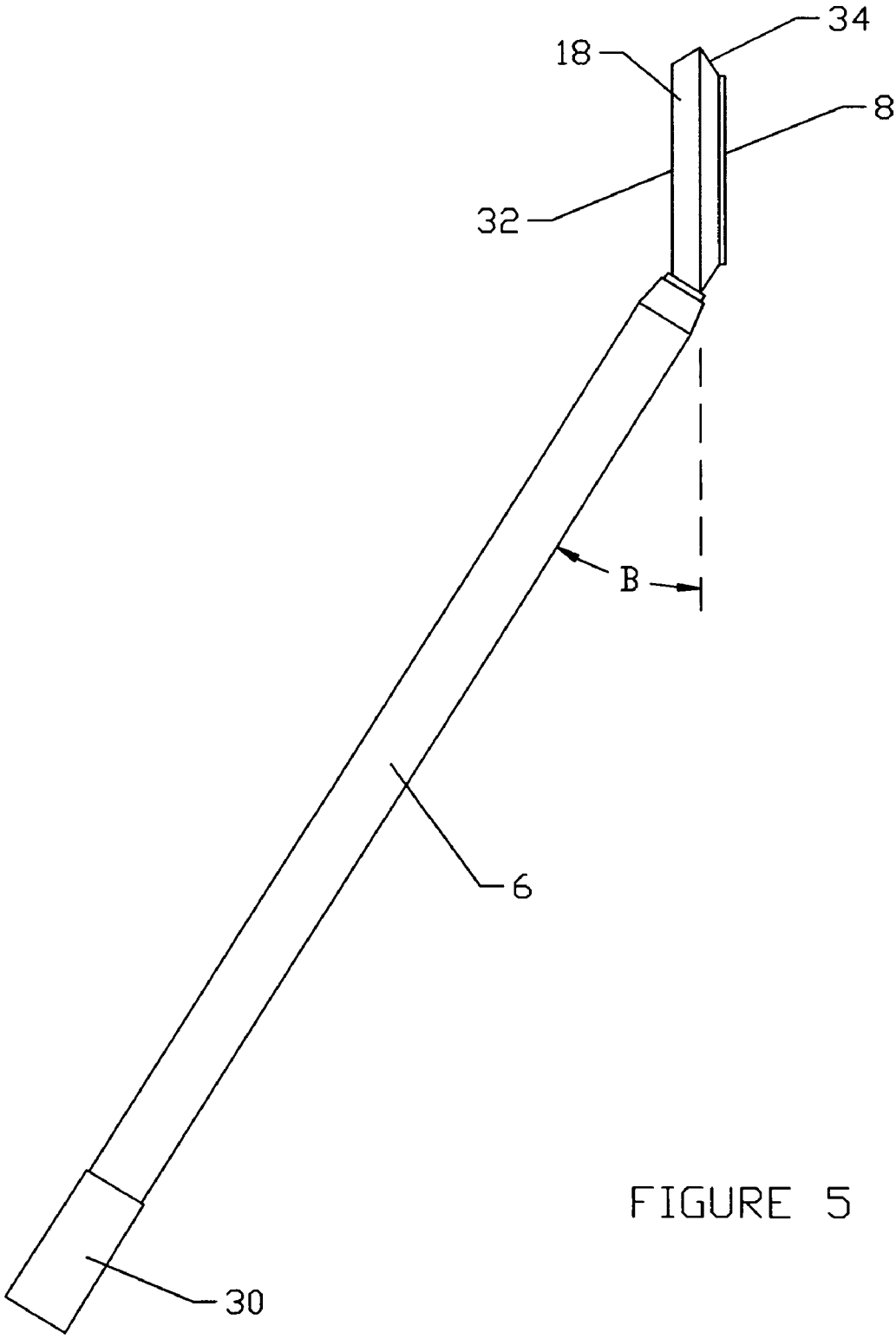
FIG. 5 is a side plan view of the bow stand invention.

Referring now also to FIGS. 3–5, details of the structure of invention 2 can better be seen. Base 8 of invention 2 includes a central axial opening 12 within bowl 36, for passing the bolt 10 therethrough and into lower end 29 of riser 7.

Base 8 comprises an outer rim 18 to which legs 4 and 6 are mounted. Each of legs 4, 6 are longitudinally slidably receivable on stubs 14, 16 which are secured to outer rim 18 of base 8. Each stub 14, 16 depends from rim 18 and is provided with resilient O-rings 20, 22 with first O-ring 20 spaced apart from rim 18 and second O-ring 22 spaced a short distance from free end 24 of stub 14. O-rings 20, 22 provide sliding resistance to the interiors of legs 4, 6. O-rings 20, 22 are received in annular grooves in the conventional manner.

Each leg 4, 6 is preferably a hollow elongate barrel having a diameter of approximately 0.40 inch and a sidewall thickness of approximately 0.013 inch. Legs 4, 6 are preferably identical and interchangeable. Legs 4, 6 are preferably very low in mass and aluminum is a satisfactory material to use. Lengths of aluminum arrow shaft stock satisfy the requirements for legs 4, 6. A bushing 42 is installed in receiving ends 44, 46 of each leg 4, 6 to provide a friction fit of legs 4, 6 on O-rings 22, 20. It is found that stubs 14, 16 may be preferably one-half inch to two inches in length while legs 4, 6 are preferably 6–10 inches in length. Each leg 4, 6 may include a resilient end cap 26 on the lower free ends 24, 26 of legs 4, 6 respectively.

Stubs 14, 16 and therefore legs 4, 6 are separated by angle A which may be from twenty to sixty degrees and preferably is approximately forty degrees such that invention 2 provides a stable support when cooperating with a stabilizer as a tripod. Preferably the length of each leg 4, 6 is approximately ten inches but may be varied.

From FIG. 5, it can be seen that legs 4, 6 preferably extend forward of outer end 32 of base 8 at angle B which is preferably about thirty degrees. Therefore legs 4, 6 define an angle of approximately sixty degrees with the central axis of bowl 36 of base 8. For ease of manufacture, legs 4, 6 extend perpendicularly from outer rim 18, so, of necessity outer rim 18 must be oriented at approximately thirty degrees from the axis of central opening 12 of base 8. Inner chamfer 34 is machined at about forty five degrees to provide a conical outer shape for base 8.

When base 8 is located on lower limb 11 after the provided conical washer is removed, base 8 is best oriented such that stubs 14, 16 are symmetrical on the riser 7 of bow 3. Base 8 need not be removed from bow 3 when it is stored in a case because legs 4, 6 are easily removable from stubs 14, 16 and legs 4, 6 may be stored conveniently in an arrow storage area or other compartment of a bow case. While shooting the bow 3, legs 4, 6 may be quickly removed and stored in the user's quiver or pocket until legs 4, 6 are returned to stubs 14, 16 when the bow 3 is to be set down. In addition, legs 4 and 6 can be removed when bow 3 is to be used but, because of their low mass and symmetric orientation on the riser 7 of bow 3, their presence will not negatively affect aiming of the bow 3.

Because free ends 24, 26 of legs 4, 6 respectively and free end 15 of stabilizer 5 define a plane, invention 2 is useful to support bow 3 on generally horizontal surfaces with stabilizers of varying lengths. For example, if a short stabilizer were attached to bow 3, the bow would rest on the free end of the stabilizer and on each leg 4, 6 though the bow would be tipped further forward than illustrated in FIG. 1.

Figure 6:
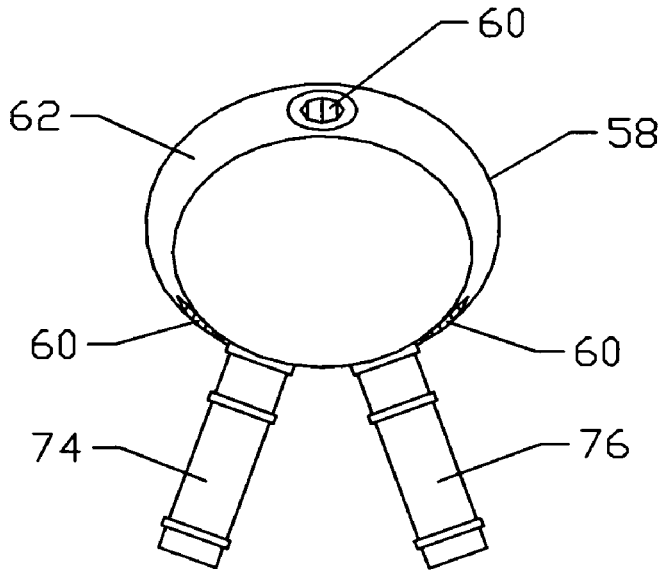
FIG. 6 is a front perspective of the base element of a first alternate embodiment of the invention.
Figure 7:
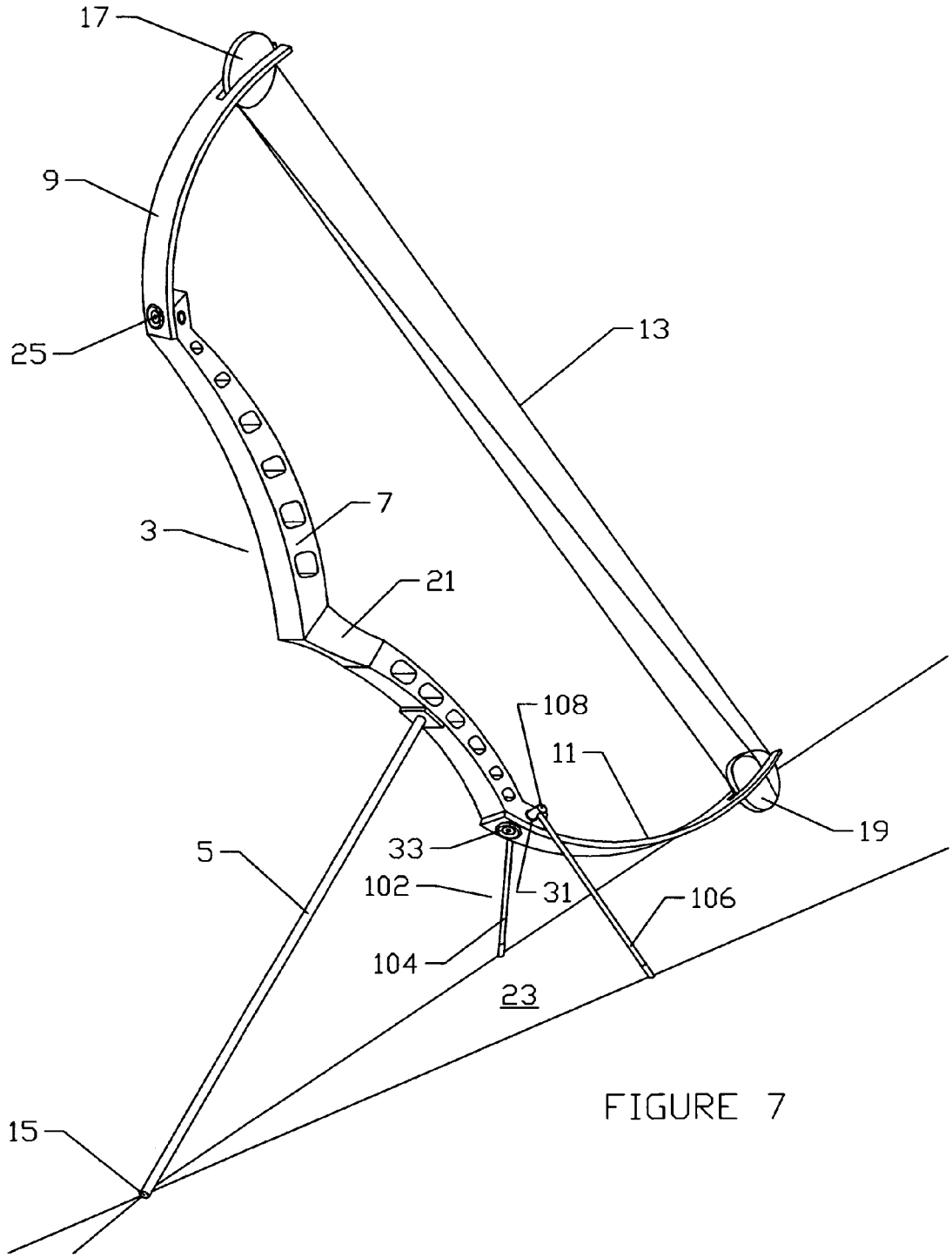
FIG. 7 is a front perspective of a bow equipped with a second alternate embodiment of the invention.

FIG. 6 discloses an alternative embodiment base element 58 which is in the nature of a cap or cover for a limb washer similar to conical washer 25 of bow 3 shown in FIG. 1 or such as limb washer 33 seen in FIG. 7 which adjustingly retains lower limb 11 to lower end 29 of riser 7. Base element 58 is sized to overlie limb washer 33 and be removably attached thereto by use of set screws 60. Base element 58 comprises a peripheral sidewall 62 from which posts 74, 76 depend. Posts 74, 76 are preferably equivalent to stubs 14, 16 of the preferred embodiment of FIG. 4, and legs 104 and 106 may be longitudinally slidingly received upon posts 74, 76 in like manner to the sliding attachment of legs 4, 6 to stubs 14, 16 of the preferred embodiment of invention 2.

FIG. 7 discloses an alternate embodiment bow stand 102 mounted to riser 7 of a bow 3 which includes the same structural elements as bow 3 illustrated in FIG. 1. Bow stand 102 includes mounting element 108 which is mounted to a threaded bore 31 of riser 7 (see FIG. 2) which is available on many compound bows like bow 3. Mounting element 108 may comprise an elongate centrally threaded shaft 112 such as is illustrated in FIG. 8 or it may be a pair of short posts with threaded ends which are screwed into riser 7 from opposing ends of the threaded bore 31 or it might be a pair of posts which are inserted from opposing sides of the riser 7 and bolted together by a screw coupling.

Figure 8:
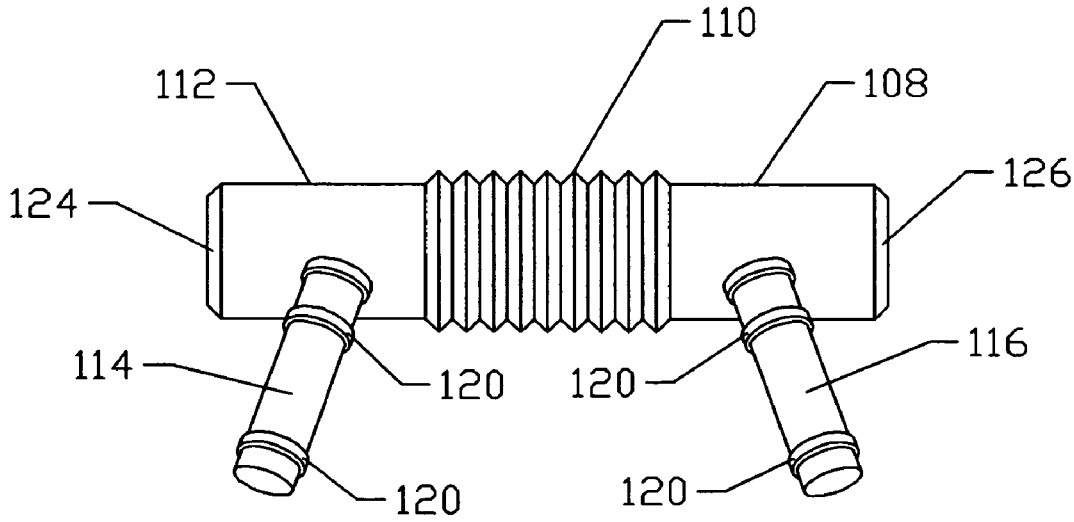
FIG. 8 is a front elevation of the base element of the second alternate embodiment of the invention.

In the alternate embodiment of FIGS. 7, 8, the mounting element 108 has central threads 110 on elongate shaft 112 for engagement with threads within threaded bore 31. Opposing ends 124, 126 of mounting element 108 remain exterior of riser 7 on its opposing sides when central threaded portion 110 is engaged with threaded bore 31. Fixed preferably at perpendiculars to ends 124, 126 are posts 114 and 116 which extend from ends 124, 126 substantial transversely to the longitudinal axis of mounting element 108. Each stub 114, 116 may include annular O-rings 120 therealong which assist in frictionally retaining legs 104, 106 in sliding engagement upon stubs 114, 116. Legs 104, 106 may be of identical construction to legs 4, 6 of the preferred embodiment of FIGS. 1–5, though legs 104, 106 may be longer or shorter depending on the location of threaded bore 31 on riser 7. Mounting element 108 may be installed in threaded bore 31 and then legs 104, 106 may be slid onto stubs 114, 116 on which the bow 3 may be rested, with legs 104, 106 providing two legs of a tripod and the stabilizer 5 making the third leg. It should be understood that legs 104, 106 may be quickly and easily slid onto stubs 114, 116 when the bow 3 is to be rested on a surface and legs 104, 106 may be removed quickly and easily when the bow 3 is to be shot. However, due to their low mass which is preferably less than one-half ounce each, and their attachment to riser 7, legs 114, 116 will not influence the balance and physical operation of bow 3.

The foregoing description of the invention has been presented for purposes of illustration and description and is not intended to be exhaustive or to limit the invention to the precise form disclosed. Modifications and variations of the embodiments are possible in light of the above disclosure or such may be acquired through practice of the invention. The embodiments illustrated were chosen in order to explain the principles of the invention and its practical application to enable one skilled in the art to utilize the invention in various embodiments and with various modifications as are suited to the particular use contemplated. It is intended that the scope of the invention be defined by the claims appended hereto, and by their equivalents.

The invention claimed is:

1. A bow stand for an archery bow comprising
a base element selectively mountable to a riser of the bow,
at least two legs depending from the base element,
each leg having a free end,
each leg comprises a barrel slidingly receivable on a stub,
whereby the free ends of the legs and a bow component cooperate to form a tripod to support the bow.

2. The bow stand of claim 1 wherein
the base element has an outer rim,
each stub fixed to the outer rim.

3. The bow stand of claim 2 wherein
each stub comprises a fixed end fixed to the outer rim and a free end opposing the fixed end thereof,
each stub comprising a first annular groove adjacent the fixed end thereof and a second annular groove adjacent the free end thereof,
an O-ring fitted within each annular groove or each stub.

4. The bow stand of claim 3 wherein
each stub is approximately one-half inch to two inches in length,
each barrel approximately six to ten inches in length,
each barrel frictionally received on a one of the stubs.

5. The bow stand of claim 1 wherein
each stub comprises at least one O-ring annularly mounted thereto.

6. The bow stand of claim 1 wherein
the base comprises a cap selectively attachable to an adjustment washer adjustably retaining a lower limb of the bow to a lower end of a riser thereof.

7. The bow stand or claim 6 wherein
the cap comprises at least one set screw touchingly engageable with the adjustment washer to secure the cap to the adjustment washer.

8. A bow stand for mounting to a compound bow having a central riser and a lower limb mounted to a lower end of the riser, the bow having a stabilizer mounted thereto, the invention comprising
a base element mounted to the riser of the bow,
the base element having a pair of spaced apart, elongated legs depending therefrom,
each leg having a free end,
the stabilizer having a free end,
the free ends of the legs and the free end of the stabilizer defining a plane,
each leg comprises a stub having an elongate barrel selectively mounted thereto,
each stub includes a first O-ring adjacent the free end thereof and a second O-ring adjacent the fixed end thereof.

9. A bow stand for mounting to a compound bow having a central riser and a lower limb mounted to a lower end of the riser, the bow having a stabilizer mounted thereto, the invention comprising
a base element mounted to the riser of the bow,
the base element having a pair of spaced apart, elongated legs depending therefrom,
each leg having a free end,
the stabilizer having a free end,
the free ends of the legs and the free end of the stabilizer defining a plane,
each leg comprises a stub having an elongate barrel selectively mounted thereto,
each barrel has an internal diameter of approximately 0.4 inches and a sidewall of approximately 0.013 inch thickness,
each barrel approximately ten inches in length,
each stub being approximately one inch in length,
each barrel has a resilient end cap on the free end thereof,
each barrel having a bushing in an end thereof opposing the free end thereof,
the bushing frictionally resisting movement along the stub.

10. A bow stand for an archery bow comprising
a base element selectively mountable to a riser of the bow,
at least two legs depending from the base element,
each leg having a free end,
whereby the legs and a bow stabilizer cooperate to form a tripod to support the bow.

11. The bow stand of claim 10 wherein
the base element is mounted to the bow at a junction of a lower limb and the riser thereof.

12. The bow stand of claim 10 wherein the base element mounts to a limb bolt joining the lower limb to the riser.

* * * * *